US005078636A

United States Patent [19]

Clarke et al.

[11] Patent Number: 5,078,636

[45] Date of Patent: Jan. 7, 1992

[54] BUBBLE MAKER WITH TOP RESERVOIR ON A GLIDER

[76] Inventors: William A. Clarke, 4549 Budd Dr., Erie, Pa. 16506; John P. Lantzy; Calvin S. Cook, both of 10021 W. Main St., North East, Pa. 16428

[21] Appl. No.: 496,293

[22] Filed: Mar. 20, 1990

[51] Int. Cl.[5] ..... A63H 33/28; A63H 27/00

[52] U.S. Cl. ..... 446/15; 446/20; 446/61

[58] Field of Search ..... 446/15, 16, 17, 19, 446/20, 34, 46, 48, 61, 68

[56] References Cited

U.S. PATENT DOCUMENTS

| | | | |
|---|---|---|---|
| 823,388 | 6/1906 | Blonde | 446/20 |
| 2,741,068 | 4/1956 | Hollis | 446/20 |
| 3,002,314 | 10/1961 | Brottman | 446/15 |
| 3,008,263 | 11/1961 | Ellman | 446/15 |
| 3,600,842 | 8/1971 | Bryman | 446/15 |

FOREIGN PATENT DOCUMENTS

| | | | |
|---|---|---|---|
| 2040532 | 8/1970 | Fed. Rep. of Germany | 446/15 |
| 701299 | 12/1953 | United Kingdom | 446/20 |

*Primary Examiner*—David N. Muir
*Attorney, Agent, or Firm*—Ralph Hammar

[57] ABSTRACT

A glider having one or more soap bubble forming rings each discharging a trail of bubbles. A reservoir feeds soap solution to the uppermost section of the ring. The reservoir is set back of the trailing face of the ring and the sides of the reservoir diverge outwardly to prevent trapping of air which could impede the feeding from the reservoir. The ring may be used separately for manual bubble blowing or on other toys.

7 Claims, 3 Drawing Sheets

BUBBLE MAKER WITH TOP RESERVOIR ON A GLIDER

SUMMARY OF THE INVENTION

This invention is a toy glider which can be thrown through the air and which emits one or more streams of bubbles throughout its flight which can simulate a jet engine exhaust.

This invention also includes an improved bubble forming ring which has the capacity to form bubbles throughout the flight or until the glider lands on the ground and an improved structure for mounting the ring on the glider. The ring is also usable separately for other mobile toys and by individuals who wish to blow bubbles with less frequent dipping of the ring in a soap solution.

When a bubble forming ring is dipped in a soap solution, a soap film is formed across the inside diameter of the ring as it is removed from the solution. This film may be blown into a bubble by a stream of air through the ring. After a few successive bubbles, the bubble formation stops.

We have found that the bubble formation stops because the uppermost section of the ring is dry interrupting the formation of a soap film across the ring and that by an addition of soap solution to the dry section of the ring, the bubble forming capability is restored.

By adding a reservoir to the top of the ring, the bubble forming capability can be extended. The reservoir feeds the upper section of the ring. The lower section of the ring is fed by gravity from the upper section.

DESCRIPTION OF THE PREFERRED EMBODIMENT

Figure 1:
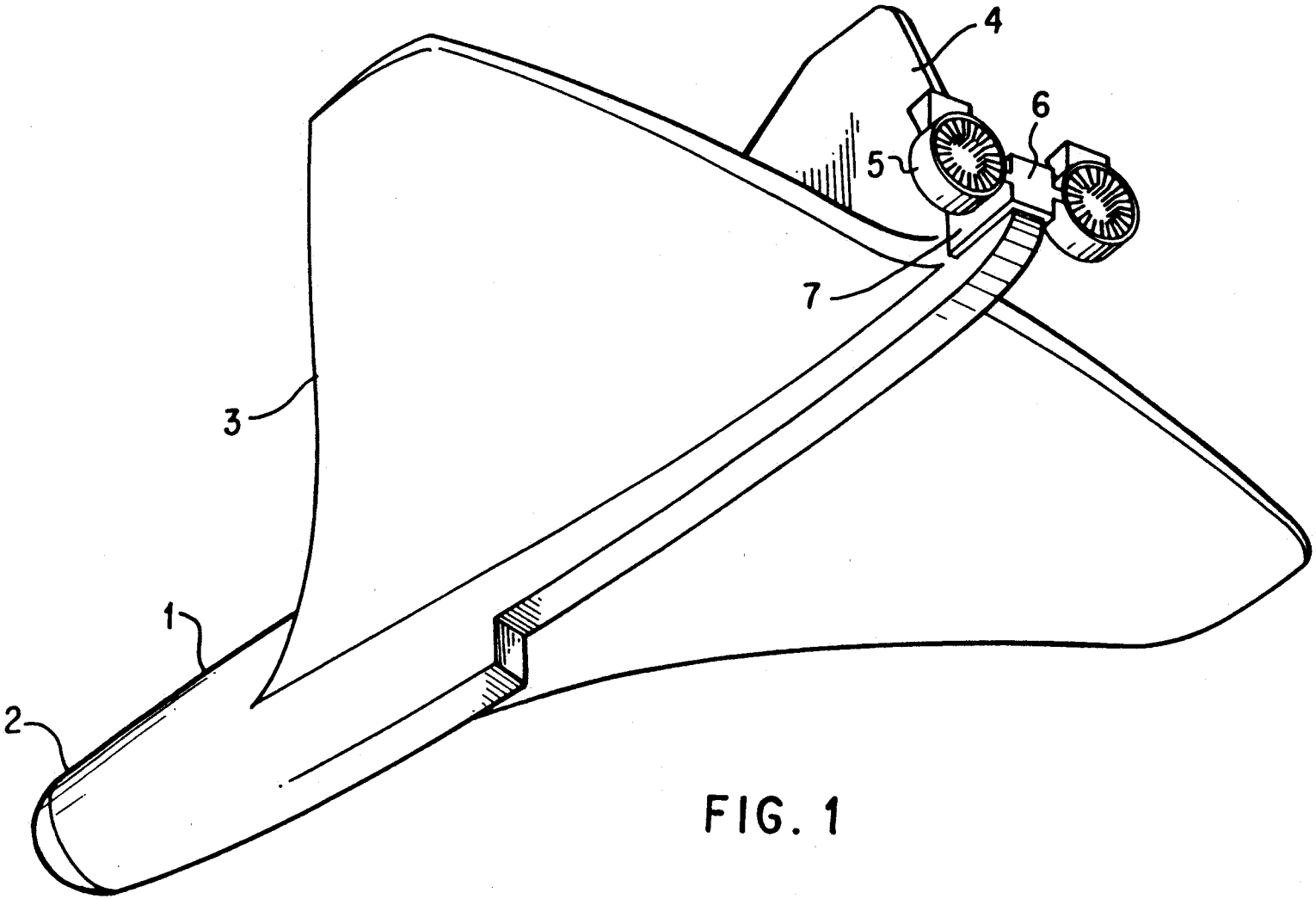
FIG. 1 is a perspective of a glider equipped with bubble forming rings.
Figure 2:
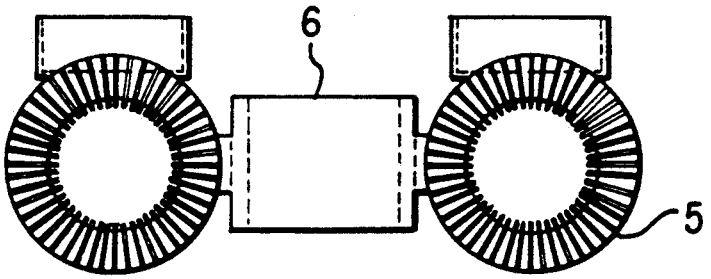
FIG. 2 is a rear elevation of the bubble forming rings of FIG. 1.
Figure 3:
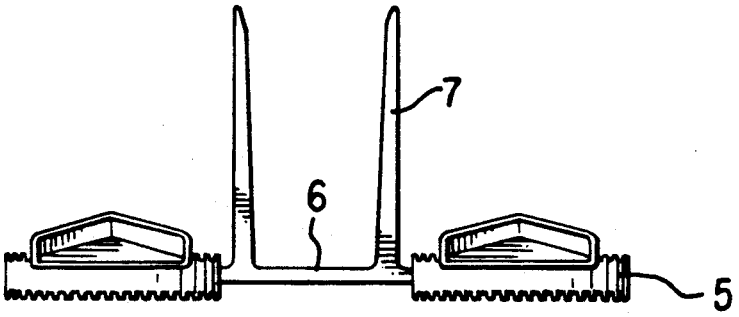
FIG. 3 is a top plan view of the bubble forming rings.
Figure 4:
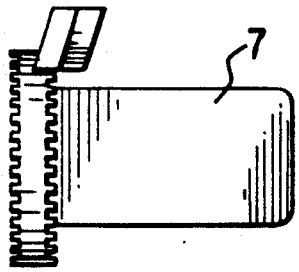
FIG. 4 is a side elevation of the rings.

The common parts of the glider are relatively identified, 1 being the fuselage, 2 the nose, 3 the wings, and 4 the tail.

In the positions occupied by jet engines are bubble forming rings 5 integral with clip 6 having arms 7 straddling and releasably gripping the tail 4 or a portion of the fuselage adjacent the tail 4. The longitudinal axes of the rings are parallel to the longitudinal axis of the glider and the bubble rings 5 are in a plane perpendicular to the longitudinal axis of the glider. As the glider travels through the air, air flows from the leading face 8 of the bubble rings through the rings and blows into bubbles the soap films which have formed across the inside diameter of the rings on the trailing face 9 of the rings. The discharge of bubbles simulates the jet streams of aircraft engines.

The bubble generating rings 5 could be plain rings. For the purpose of increasing the retention of soap solution, there are a series of angularly spaced ribs 10 projecting into the bore of each ring and having radial extensions 11 and 12 respectively on the leading and trailing end faces of the rings. The ribs 11 on the trailing face 9 of the rings are uninterrupted. The ribs 12 on the leading face 8 of the rings are cut away adjacent the outer periphery to provide a recess receiving a reservoir 13. The reservoir holds a load of soap solution much greater than could be obtained from several dips of the rings into soap solution.

Figure 5:
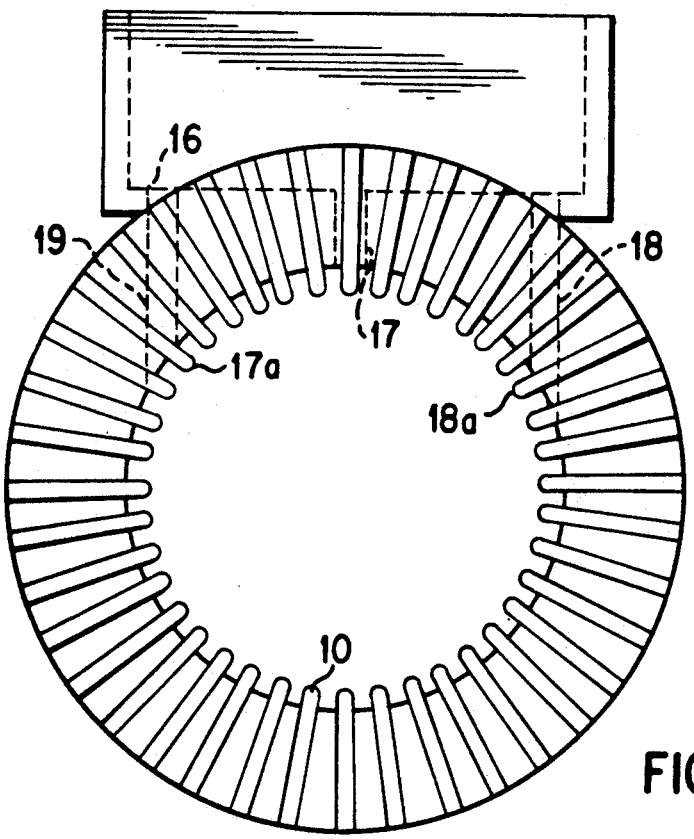
FIG. 5 is an enlarged rear elevation of one of the bubble forming rings.

At the bottom of each reservoir are feed holes 14, 15 and 16 through which soap solution drains continuously after the reservoir is filled. Feed hole 14 is midway between the leading and trailing faces of the ring and feeds soap solution to the spaces between the uppermost group of ribs 10 through drain hole 17. This supplies soap solution to the ribs above and between the ribs 17*a* and 18*a* in the upper quadrant or section of the rings. Feed holes 15 and 16 supply soap solution to the remaining ribs 10. Feed hole 15 registers with drain hole 18 and feeds the ribs below drain hole 18 and to the right of drain hole 17 as viewed in FIG. 5. Feed hole 19 registers with feed hole 16 and feeds solution to the ribs below feed hole 19 and to the left of feed hole 17 as viewed in FIG. 5. By this means, the bores of the bubble rings are kept supplied with soap solution throughout the flight of the glider which may be from 30 to 50 feet and may take from 5 to 8 seconds or longer. Throughout this flight a realistic stream of soap bubbles will be emitted from the bubble rings and will simulate jet engine discharge.

While the dual rings may be more realistic, a single stream of bubbles may be all that is required for the desired effect. A single ring may be mounted on the nose of the glider.

Figure 8:
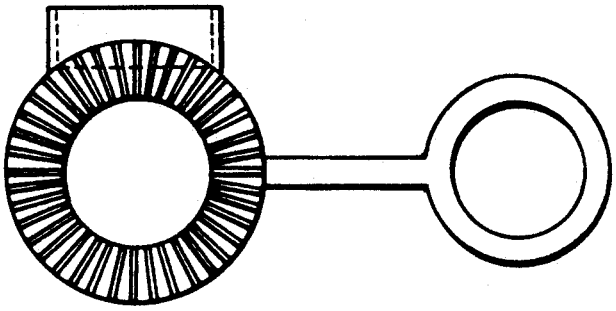
FIG. 8 is a view of the FIG. 5 ring supported at one end of a wand for manual dipping.

A single ring may be mounted on the remote end of a wand for the manual dipping for bubble blowing. This is shown in FIG. 8. The rings may also be mounted on other toys.

Figure 6:
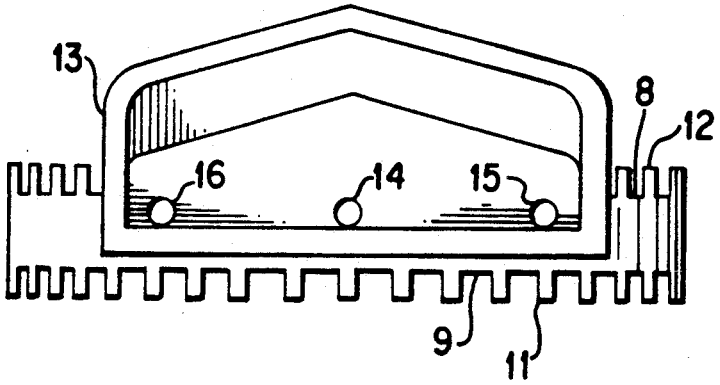
FIG. 6 is a top view of the FIG. 5 ring.
Figure 7:
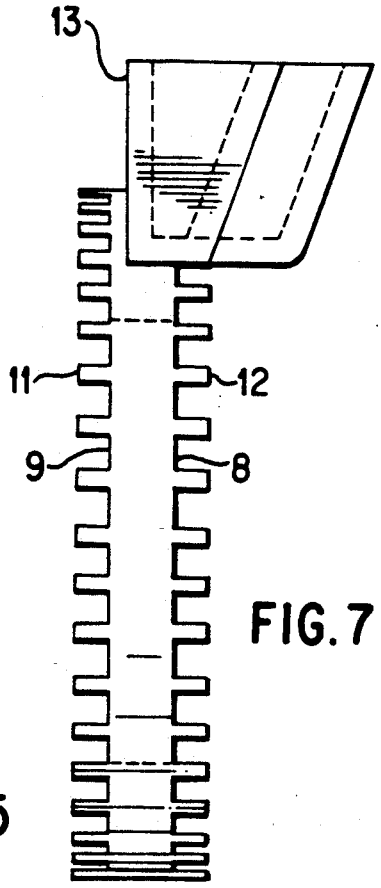
FIG. 7 is an edge view of the FIG. 5 ring.

In FIGS. 6 and 7, the leading and trailing walls of the reservoir diverge from the bottom to the top of the reservoir. This divergence prevents trapping of air in the reservoir during filling. Air drains from the reservoir in advance of the liquid fill.

If the air flow through the ring were reversed, i.e., the air entered through face 9 and exited through face 8, the bubble emitted would spread to include the outer surface of projection 20 of the reservoir and bubble formation would stop as soon as this surface became dry.

We claim:

1. A soap bubble ring having a continuous surface surrounding a central axis of the ring for forming a film of a soap bubble solution across said surface by dipping the ring in a soap solution, which film may be blown into a bubble by a draft of air along said axis from a leading face 8 through a trailing face 9 of the ring, a reservoir for soap solution on a normally uppermost portion of said ring upstream of trailing face 9 and one or more feed holes from the reservoir to the normally uppermost portion of said ring for supplying soap solution by gravity to the uppermost section of said trailing face some of which solution drains down to supply the lower section of said trailing face and maintain said trailing face wet with soap solution and means for attachment to another device for elevated movement through air so that a plurality of bubbles is produced by said movement through air.

2. The ring of claim 1 in which said surface has a plurality of closely spaced projections for increasing the soap solution holding ability.

3. The combination of the ring of claim 1 with a wand for manually supporting the ring for dipping in soap solution and for bubble blowing.

4. The ring of claim 1 in which the reservoir is set back from the face of the film forming surface.

5. The ring of claim 1 in which the reservoir has sides which diverge outwardly to prevent trapping of bubbles in the reservoir which could impede feeding from the reservoir.

6. The ring of claim 1 in which the reservoir projects in front of said leading face 8.

7. A soap bubble ring of claim 1 wherein said another device is a toy glider.

* * * * *